United States Patent [19]

Nilsson

[11] Patent Number: 4,874,039

[45] Date of Patent: Oct. 17, 1989

[54] PLATE HEAT EXCHANGER

[75] Inventor: Bo Nilsson, Kävlinge, Sweden

[73] Assignee: Alfa-Laval Thermal AB, Tumba, Sweden

[21] Appl. No.: 216,540

[22] PCT Filed: Dec. 28, 1987

[86] PCT No.: PCT/SE87/00634

§ 371 Date: Jun. 28, 1988

§ 102(e) Date: Jun. 28, 1988

[87] PCT Pub. No.: WO88/05520

PCT Pub. Date: Jul. 28, 1988

[30] Foreign Application Priority Data

Jan. 16, 1987 [SE] Sweden ..... 8700162

[51] Int. Cl.[4] ..... F28F 3/08

[52] U.S. Cl. ..... 165/78; 165/167

[58] Field of Search ..... 165/78, 167

[56] References Cited

U.S. PATENT DOCUMENTS 2,287,958 6/1942 Astle ..... 165/78
2,428,880 10/1947 Kintner ..... 165/167
4,499,942 2/1985 Allison ..... 165/78

FOREIGN PATENT DOCUMENTS 2059122 6/1971 Fed. Rep. of Germany .
2000144 7/1971 Fed. Rep. of Germany .
2311488 9/1973 Fed. Rep. of Germany .
2713977 10/1978 Fed. Rep. of Germany .
525463 9/1921 France .
240732 10/1925 United Kingdom .

OTHER PUBLICATIONS

Bond, Plate Heat Exchangers, U.K. Patent Applications, 12/1980.

Usher, Improvements in or Relating to Plate Heat Exchangers, U.K. Patent Applications, 9/1980.

*Primary Examiner*—Ira S. Lazarus
*Assistant Examiner*—Christopher Hayes
*Attorney, Agent, or Firm*—Davis Hoxie Faithfull & Hapgood

[57] ABSTRACT

A plate heat exchanger has a frame plate, a pressure plate and heat exchange plates clamped therebetween, all suspended from a carrying bar passing through a hole in the pressure plate and extending at least some distance into a corresponding hole in the frame plate. The pressure plate is slidable on the carrying bar. The frame plate and the pressure plate are identical so that the hole for the carrying bar in the frame plate is identical to the hole for the carrying bar in the pressure plate. The carrying bar is fastened in the frame plate by means of a locking device.

10 Claims, 1 Drawing Sheet

PLATE HEAT EXCHANGER

Figure 1:
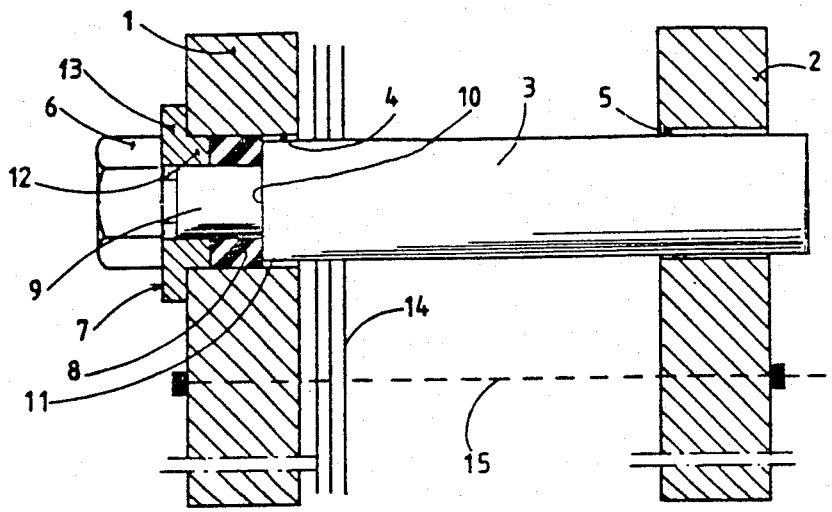

The present invention relates to a plate heat exchanger comprising a frame plate and a pressure plate and heat exchange plates clamped therebetween, which heat exchange plates are suspended from a carrying bar passing through a hole in the pressure plate and extending at least a distance into a corresponding hole in the frame plate.

A plate heat exchanger comprises, as mentioned, a frame plate and a pressure plate, which usually are termed end plates, and heat exchange plates arranged between these. Further, the plate heat exchanger comprises an upper carrying bar, in which the heat exchange plates are suspended, and usually a lower guiding bar, which also is intended to cooperate with the heat exchange plates for determining their positions. The frame plate and the pressure plate differ as a rule from each other referring to their design. Thus, the frame plate may as an example be provided with four ports, two for each heat exchange medium, while the pressure plate thus would not need to have any single port. Another essential difference between the frame plate and the pressure plate is that the sizes of the holes for the carrying bar and the guiding bar are unequal. The reason hereto is that the carrying bar and the guiding bar are intended to be fastened to the frame plate, while the pressure plate should be slidable towards and backwards along these bars, depending on the amount of heat exchange plates mounted between the frame plate and the pressure plate. Thus, it has been usual that the pressure plate has been provided with a hole for the carrying bar and the guiding bar having a diameter somewhat larger than the diameter of the carrying bar and the guiding bar, while the frame plate, however, has had a smaller hole which has been threaded and lain in engagement with a threaded outer part of the carrying bar to fasten the same to the frame plate. Another known method to fix the carrying bar and the guiding bar to the frame plate has been to fasten these by means of a bolt. The carrying bar and the guiding bar have thus with their one end surface been borne against the inner side surface of the frame plate and been fixed in this position by means of a bolt which has gone through a hole in the frame plate, which hole corresponds to the thickness of the bolt, and has engaged into the carrying bar and the guiding bar.

The consequences of these differences between the frame plate and the pressure plate has lead to that the manufacturer of plate heat exchangers has been forced to have a stock of both frame plates and pressure plates, which is both expensive and taking up a great deal of storage space.

The problem with an equal number of ports in the frame plate and the pressure plate can be solved in the way that all of the frame plates and the pressure plates being provided with four ports, whereafter the ports, which will not be used, are provided with caps. This technique to provide the ports with caps is previously known, but despite that, nobody has previously suggested a plate heat exchanger being provided with a frame plate and a pressure plate identically manufactured. The reason hereto obviously has been that one has had such a fixation on the thought that it requires conventional fastening according to the above of the carrying bar and the guiding bar, that one has not thought of the possibility to make the holes for the carrying bar and the guiding bar identical in the frame plate and the pressure plate. That one has not thought of the possibility of making the frame plate and the pressure plate identical is shown by the fact that despite that plate heat exchangers have existed on the market in at least 60 years nobody has previously suggested this solution. The present invention is thus characterized in that the frame plate and the pressure plate are identical so that the hole for the carrying bar in the frame plate is identical to the hole for the carrying bar in the pressure plate and that the carrying bar is fastened in the frame plate by means of a locking device.

This implies that for each type of plate heat exchangers only one kind of a plate need to be manufactured, which thus could be used both as a frame plate and as a pressure plate. The great advantage with this invention is that the storage of end plates becomes inexpensive and requires relatively small storage space.

Figure 2:
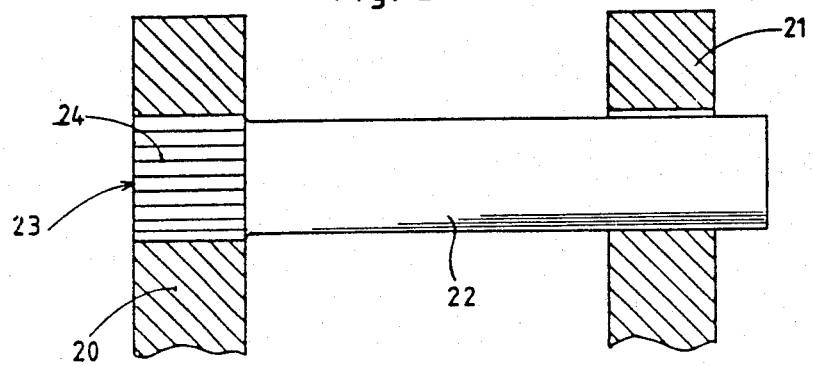
Figure 3:
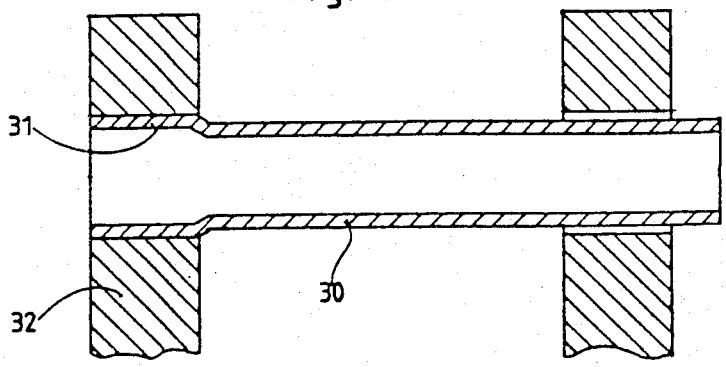

The invention will be described closer in connection with the accompanying drawing, in which FIG. 1 shows a partial cross-section view of a first embodiment of a plate heat exchanger according to the invention, FIG. 2 shows a partial cross-section view of a second embodiment of a plate heat exchanger according to the invention, and FIG. 3 shows a cross-section view of a third embodiment of a plate heat exchanger according to the invention.

Referring to FIG. 1 there is shown a frame plate 1 and a pressure plate 2 and a carrying bar 3 connecting the two plates with each other. The frame plate 1 and the pressure plate 2 has been manufactured identical, whereby the hole 4 in the frame plate and the hole 5 in the pressure plate are essentially equal.

As shown from the figure, the hole 5 in the pressure plate 2 is so big that the pressure plate can freely be displaced along the carrying bar 3. Since the hole 4 in the frame plate 1 is as big as the hole 5 in the pressure plate this implies that the frame plate would be displaceable relatively the carrying bar. As mentioned earlier the carrying bar must however be fastened into the frame plate. This fastening of the carrying bar into the frame plate is effected by means of a special locking device. The locking device is composed of a tightening means 6, a washer 7 and an expander 8.

As evident from the figure a thin portion 9 of the part of the carrying bar 3, which extends into the hole 4 of the frame plate 1, has essentially less thickness than the rest of the carrying bar. The reason hereto is that there should be space for an expander of a certain size, which is intended to surround the portion 9 of the carrying bar and thus be placed between this portion and the wall of the hole 4 in the frame plate. Further, the expander 8 bears against a shoulder 10 of the carrying bar, which is formed at the transitional area between the thin portion 9 of the carrying bar and the portion 11 of normal thickness. This transitional area is in this case arranged in the part of the carrying bar, which is located in the hole of the frame plate. Naturally, it can be arranged in another part of the carrying bar, as an example, close outside of the hole in the frame plate. This latter location, however, has the disadvantage that on one hand the expander 8 must have a larger axial extent and on the other hand the natural support between the portion 11 of the carrying bar and the frame plate becomes lost.

The washer 7 has a hollow cylindrical part 12 which surrounds the thin portion 9 of the carrying bar and whose one end bears against one side surface of the expander 8. The cylindrical part 12 of the washer 7 is thus placed between the portion 9 of the carrying bar 3 and the wall of the hole 4 in the frame plate. The other end of the cylindrical part 12 has a flange 13 which is intended to bear against the outer side surface of the frame plate.

The tightening means 6 is in this case constituted of a bolt, which is intended to engage into a threaded hole in the carrying bar. Thereby the head of the bolt is intended to bear against the flange 13 of the washer. The tightening means 6 can, instead of a bolt, consist of a nut which is provided with threads for engagement with the portion 9 of the carrying bar, whose at least outer part is also provided with threads.

The carrying bar 3 and its thin portion 9 usually have circular cross-section, whereby the hole 4, the part 12 of the washer 7 and the expander 8 at rest have circular-cylindrical shape. The carrying bar 3 and its thin portion 9 may however have another shape, as an example a form having rectangular or square cross-section. However, the outer part of the portion 9, which is provided with threads for cooperation with the nut, must be circular-cylindrical. Hereby, also the hole 4, the part 12 of the washer 7 and the expander 8 ought to have a rectangular or square cross-section.

Upon locking of the carrying bar in the frame plate the bolt or the nut 6 is tightened on the bar 9, whereby the cylindrical part 12 of the washer 7 is pressed against the expander 8. Hereby the expander is axially compressed, but radially expanded, so that its inner radial part is pressed against the portion 9 of the carrying bar, while its outer radial part is pressed against the wall of the hole 4 of the frame plate. Hereby the carrying bar is fastened in the frame plate.

It is not necessary that the carrying bar 3 is provided with a thin portion 9, but the tightening means 6 may consist of a bolt which directly engages into a threaded hole in the carrying bar 3 extending into the hole 4 of the frame plate. Upon tightening of the bolt 6 the expander 8 will expand radially so that it is pressed on one hand against the shaft of the bolt and on the other hand against the wall of the hole in the frame plate 1 and it will be compressed axially between the cylindrical part 12 of the washer 7 and one end surface of the carrying bar 3.

Even if the guiding bar of the heat exchanger is not shown on the drawing, it is lying within the scope of the invention to apply the same locking devices for the guiding bar as for the carrying bar.

According to the described embodiments in connection to FIG. 1 the devices for fastening of the carrying bar in the frame plate comprise a washer between the tightening means and the expander. It is, however, possible within the scope of this invention to modify the tightening means, i.e. the bolt or the nut, in such way that on one hand it will bear direct against the expander, and on the other hand against the side surface of the frame plate, whereby the expander upon the tightening of the bolt or the nut will be axially compressed and radially expand with a fastening of the carrying bar in the frame plate as a result.

In FIG. 1 a number of heat exchange plates have schematically been shown, which are held clamped between the frame plate 1 and the pressure plate 2 by means of a screw joint comprising two or several clamping bolts 15.

Referring to FIG. 2 there are also shown a frame plate 20, a pressure plate 21 and a carrying bar 22, which preferably are cylindrical. Thereby, like the device according to FIG. 2 the frame plate and the pressure plate are made identical, implying that the holes in the frame plate and the pressure plate are of equal size. The locking of the carrying bar into the frame plate is however effected in a different way in this case. Thus, the cylindrical end 23 of the carrying bar, which is intended to cooperate with the hole in the frame plate, has been plastically deformed by means of knurling, whereby the diameter of the end of the carrying bar has been enlarged. In this case, knurling implies that the end of the carrying bar has been deformed by means of a tool whereby longitudinal grooves 24 are formed around the envelope surface of the cylinder. Thereby the distance between the tops of the two diametrical opposite grooves 24 becomes larger than the diameter of the end 23 of the carrying bar before the deformation. Upon locking of the end 23 of the carrying bar in the frame plate 20, the end of the carrying bar is pressed into the hole of the frame plate, whose diameter is somewhat less than the distance between the tops of the two diametrical opposite grooves in the end of the carrying bar. Hereby the end of the carrying bar is locked by press force.

The carrying bars of th embodiment according to FIG. 1 and 2 can either be solid or tubular.

Also in the embodiment according to FIG. 3 the frame plate and the pressure plate are made identical, whereby the holes in these plates are of equal size. According to this embodiment the carrying bar 30 must be tubular. The locking of the end 31 of the carrying bar into the hole of the frame plate 32 is in this case also effected by press force by means of the outer diameter of the end 31 of the carrying bar having been made somewhat larger than the outer diameter of the carrying bar 30. This enlargement of the outer diameter of the end 31 of the carrying bar 30 has been effected by means of plastic deformation of the carrying bar. The plastic deformation can be made by rolling for example or by means of a mandrel which is punched into the end of the hollow carrying bar. For this reason, the carrying bar should not have a too big wall thickness.

What is claimed is:

1. Plate heat exchanger comprising a frame plate, a pressure plate, heat exchange plates clamped between said frame plate and said pressure plate and a carrying bar for supporting said plates, each of said pressure plates and said heat exchange plates having holes for receiving said carrying bar, said carrying bar passing through said hole in said pressure plate and extending at least a distance into said hole in said frame plate, said pressure plate being slidable on said carrying bar, said pressure plate and said frame plate being identical so that the hole for the carrying bar in the frame plate is identical to the hole for the carrying bar in the pressure plate and a locking device for fastening the carrying bar in the frame plate.

2. The plate heat exchanger claimed in claim 1 wherein said locking device comprises an expander and tightening means.

3. The plate heat exchanger claimed in claim 2 wherein the tightening means comprises a bolt and wherein said carrying bar has a threaded hole for receiving said bolt.

4. The plate heat exchanger claimed in claim 3 wherein the part of the carrying bar which cooperates with the frame plate has a portion reduced in cross-section relative to the remainder of the carrying bar.

5. The plate heat exchanger claimed in claim 4 wherein the locking device comprises a washer positioned between the tightening means and the expander, said washer and the expander being positioned between the wall of the hole in the frame plate and the reduced portion of the carrying bar.

6. The plate heat exchanger claimed in claim 5 wherein the carrying bar has a shoulder formed between the reduced portion and the remainder of the carrying bar, said shoulder being positioned in the hole of the frame plate, the expander bearing against said shoulder, and the washer being placed outside of said shoulder, and wherein the washer is provided with a flange for abutment against the outer surface of the frame plate, the head of the bolt being placed against the flange of the washer.

7. The plate heat exchanger claimed in claim 6 wherein the carrying bar, including its reduced portion, has a circular cross-section, the hole in the frame plate, a portion of the washer 7, and the expander 8, in its unexpanded condition, also having circular cross-sections.

8. The plate heat exchanger claimed in claim 6 wherein the carrying bar, including its reduced portion, has a rectangular or square cross-section, the hole in the frame plate, a portion of the washer, and the expander, in its unexpanded condition, also having rectangular or square cross-sections.

9. The plate heat exchanger claimed in claim 1 wherein the locking device comprises a narrowed portion of the carrying bar at an end of said carrying bar, said narrowed portion being provided with grooves and being positioned in press fit engagement with the hole in the frame plate.

10. The plate heat exchanger claimed in claim 1 wherein the carrying bar is tubular and the fastening device comprises an end portion of the carrying bar which has been plastically deformed so that its outer diameter has been enlarged to provide a press fit engagement with the hole in the frame plate.

* * * * *